US007414212B2

(12) United States Patent
Huang

(10) Patent No.: US 7,414,212 B2
(45) Date of Patent: Aug. 19, 2008

(54) EMERGENCY STOP SWITCH OF SHREDDER

(75) Inventor: Simon Huang, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 0 days.

(21) Appl. No.: 11/878,488

(22) Filed: Jul. 25, 2007

(65) Prior Publication Data

US 2008/0156910 A1 Jul. 3, 2008

(30) Foreign Application Priority Data

Dec. 27, 2006 (CN) ..... 2006 2 0175620 U

(51) Int. Cl.
*H01H 13/00* (2006.01)
*H01H 9/20* (2006.01)

(52) U.S. Cl. ..... 200/334; 200/293; 241/37.5

(58) Field of Classification Search ..... 200/334, 200/293, 296, 308, 318.2; 241/37.5
See application file for complete search history.

(56) References Cited

U.S. PATENT DOCUMENTS 4,276,459 A * 6/1981 Willett et al. ..... 200/43.17
4,454,392 A * 6/1984 Rapp et al. ..... 200/61.67
5,444,203 A * 8/1995 Gunnarsson ..... 200/510
6,483,062 B1 * 11/2002 Herdegen et al. ..... 200/538
6,745,225 B2 * 6/2004 Loh et al. ..... 709/202
6,930,267 B2 * 8/2005 Chou ..... 200/520

* cited by examiner

*Primary Examiner*—K. Richard Lee
(74) *Attorney, Agent, or Firm*—Bacon & Thomas, PLLC.

(57) ABSTRACT

An emergency stop switch of a shredder is disposed in a preformed hole on the top cover of the shredder and protrudes from the surface of the top cover for the convenience of switching. The emergency stop switch has a switch with the fwd, off, and rev modes; a brake, which is disposed on the switch and has a control part protruding from the shredder top cover for switching among the different modes and a positioning part for assuring the switch mode; a positioning base, which is disposed on a bottom surface of the shredder top cover opposite to the position of the positioning part for assuring the switch mode; and a restoring part, which releases stored energy to push the switch from the fwd or rev mode to the off mode. When the switch is in any of the fwd or rev mode and the controlling part of the brake that protrudes from the shredder is under a pressure to move downward, the positioning part of the brake departs from the normal fixing position of the positioning base so that the restoring part pushes the switch back to the off mode.

8 Claims, 5 Drawing Sheets

EMERGENCY STOP SWITCH OF SHREDDER

BACKGROUND OF THE INVENTION

1. Field of Invention

The invention relates to a shredder and, in particular, to an emergency stop switch (ESS) that can immediately stop the operation of shredder to prevent serious injuries.

2. Related Art

To prevent such documents as legal files, receipts, invoices, credit card numbers, research reports, or personal financial information (e.g., credit card and phone bills) from being released, it is common to destroy them using a shredder. Therefore, the shredder has become an indispensable device for both business and home applications.

As is well known, the action principle of a shredder for shredding paper is to dispose several cutting blades on two rotary shafts with spacers in between. A motor and a gear box are employed to drive the two parallel rotary shafts that rotate in opposite directions. They provide a shearing force on passing paper to cut it into small stripes. According to the mechanical cutting type, shredders can be classified as stripe-cut shredders and cross-cut shredders. In the former case, the cutting blades are disposed regularly on the rotary shafts and cut the paper along the longitudinal direction into long stripes. Each blade in the latter case has several hook-shaped cutting edges. The blades are disposed in a spiral way on the rotary shafts. In this case, the paper is not only cut along the longitudinal direction into stripes, but also cut in the transverse direction into chips.

The panel of a conventional shredder is usually provided with an on/off switch. The user can use his/her finger to push the switch so that the shredder operates among the auto, off, and rev modes. The shredder is normally in the auto mode for the user's convenience to insert paper for shredding. However, when the shredder encounters an emergency and has to stop immediately in the auto mode, the user has to switch to the off mode. Even though the switch is clearly marked with the off, auto, and rev modes, it is sometimes too urgent so that the user cannot react correctly and put the shredder in the off mode. This often results in injuries.

SUMMARY OF THE INVENTION

An objective of the invention is to provide an ESS for the shredder so that it can immediately stop to avoid further injuries.

To achieve the above objective, the disclosed ESS of a shredder is disposed in a preformed ole on the top cover of the shredder and protrudes from the top cover surface for the convenience of switching. It includes a switch with few, off, and rev modes, a brake disposed on the control part for switching the modes protruded from the top cover of the switch, a positioning part for assuring the switch mode, a restoring part disposed at the bottom surface of the top cover opposite to the positioning part and corresponding to the positioning base of the positioning part for pushing the switch from the fwd or rev mode to the off mode using the restored therein. When the switch is in either fwd or rev mode, the control part of the brake that protrudes form the top cover of the shredder is depressed to have a downward displacement. The positioning part of the brake departs from the normal fixing position with the positioning base. The restoring part pushes the switch back to the off mode.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
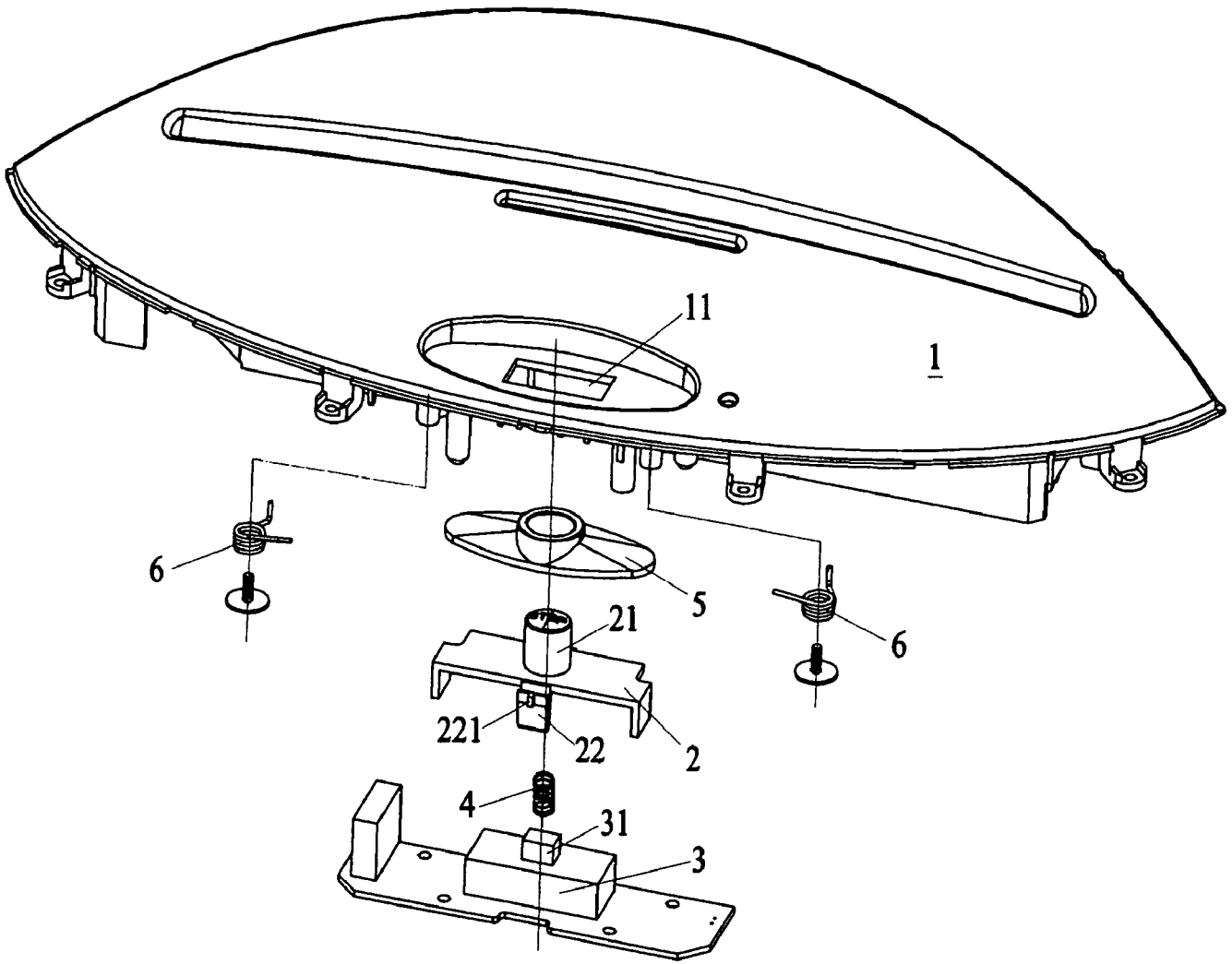
FIG. 1 is an exploded view showing the structure of the invention from a first viewing angle.
Figure 2:
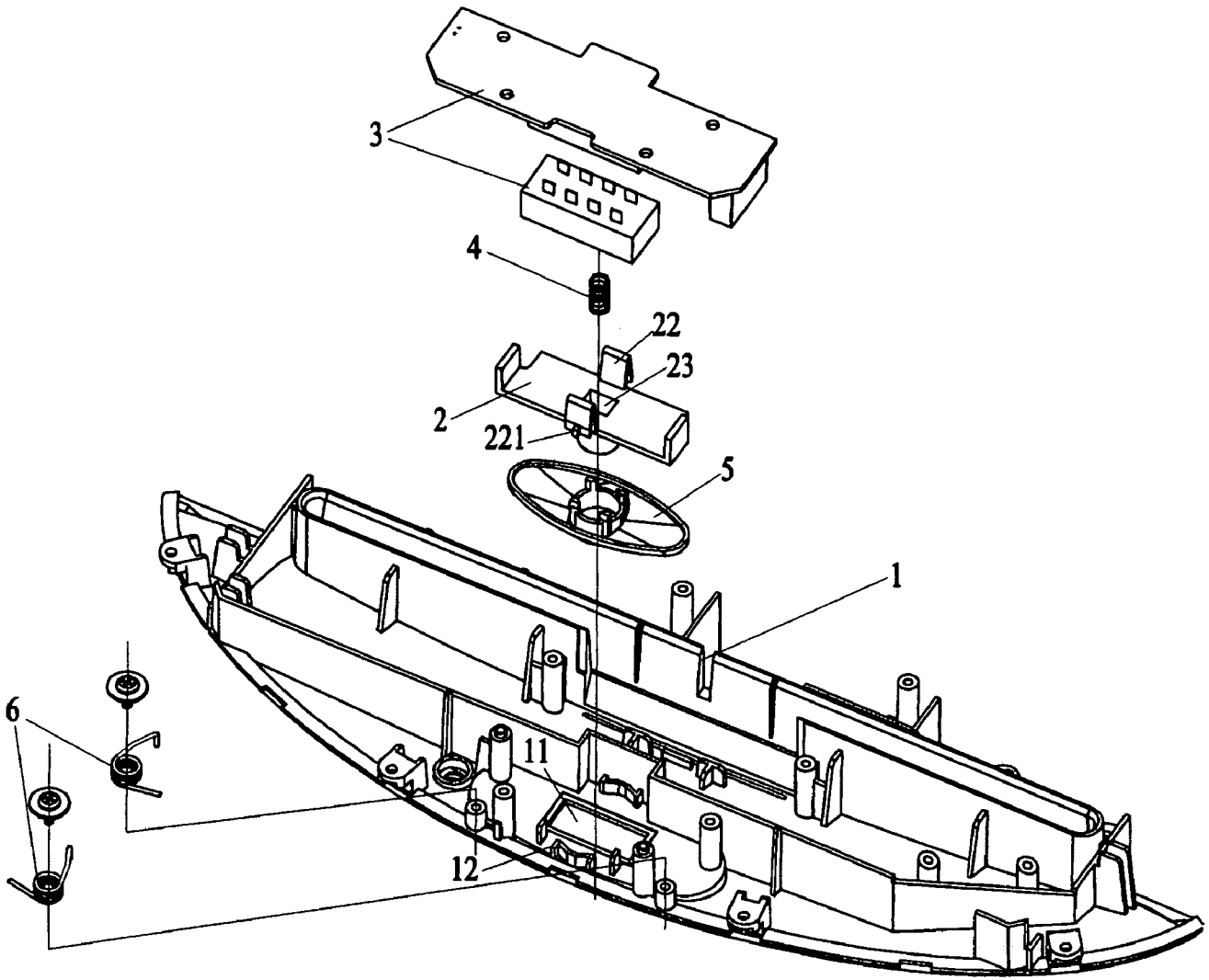
FIG. 2 is an exploded view showing the structure of the invention from a second viewing angle.

FIGS. 1 and 2 show the structure of the invention from different viewing angles. Generally speaking, the emergency switch of the invention is disposed in a preformed hole 11 on the top cover 1 of the shredder, as in the conventional shredder. It protrudes from the surface of the top cover 1 for the convenience of switching. The invention is featured in that it provides a brake 2 on the conventional switch. A positioning block 31 protruding from the central position of the switch 3 is mounted inside a predetermined positioning hole 23 at the bottom center of the brake 2 using a compressible spring 4. The switching between the operating mode (the fwd or rev mode) and the off mode of the switch 3 is achieved by pushing the brake 2. A cylindrical button 21 protruding upward from the front surface of the brake penetrates through the preformed hole 11 of the top cover 1 and connects to a decorative cap 5, thus protruding from the shredder top cover. V-shaped elastic chips 22 are provided on both sides at the center of the b rake 2. The center of the elastic chip 22 is further provided with a lock button 221. As shown in FIG. 2, a torque spring 6 is provided on each side of the brake 2 at the bottom of the shredder top cover 1 to constantly impose a pressure on the brake 2.

Figure 3:
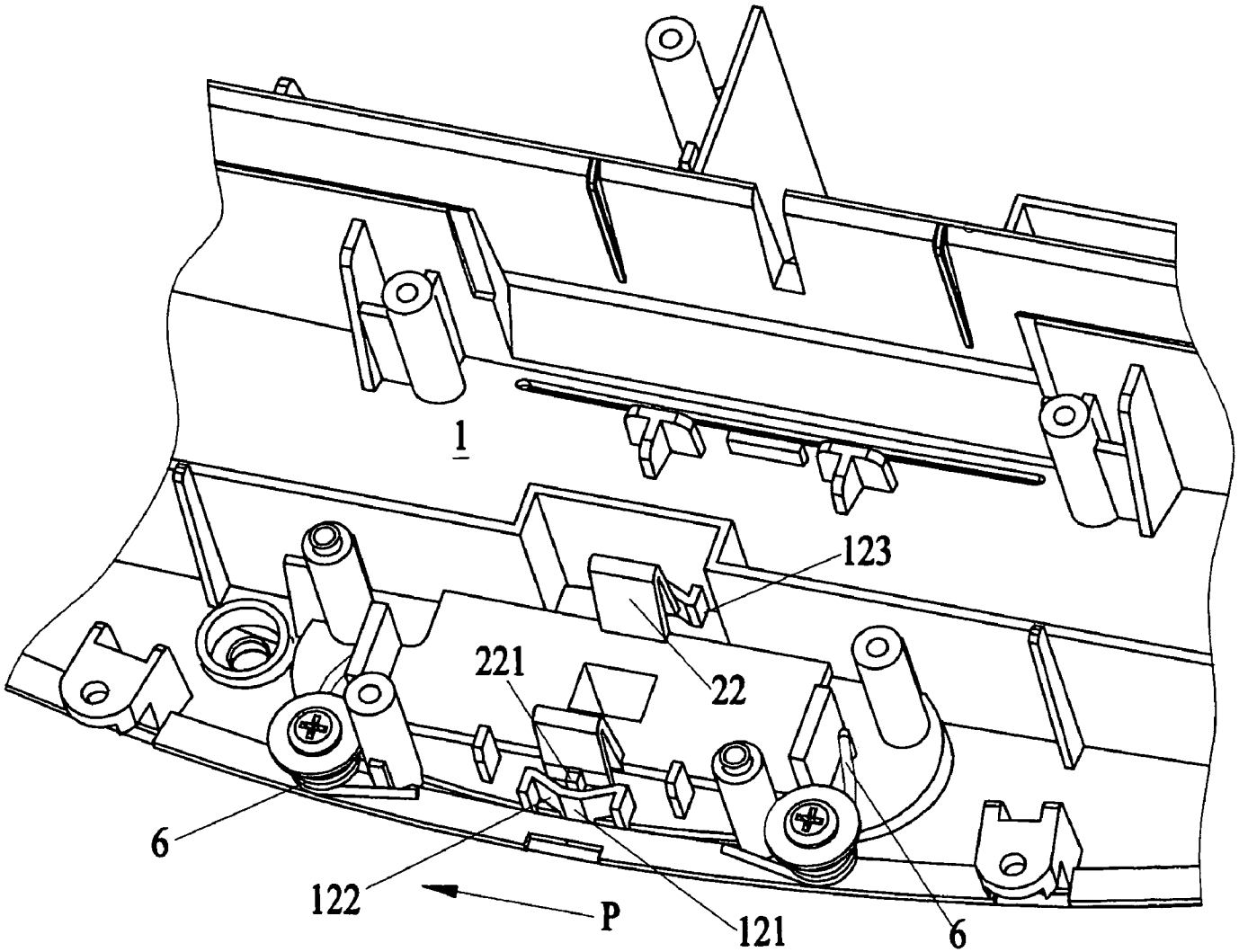
FIG. 3 shows the positions of various components of the shredder in its off mode according to the invention.

With reference to FIG. 3, the hole 11 on the bottom surface of the shredder top cover 1 is formed with a positioning base 12 corresponding to the position of the brake 2 on each side. The center of the positioning base 12 has a small flat surface 121. The flat surface 121 extends on both sides with an increasing slope to form a slant surface 122. The end of the slant surface 122 is bent backward to form a wall surface 123. Therefore, it has roughly an M shape.

Figure 4:
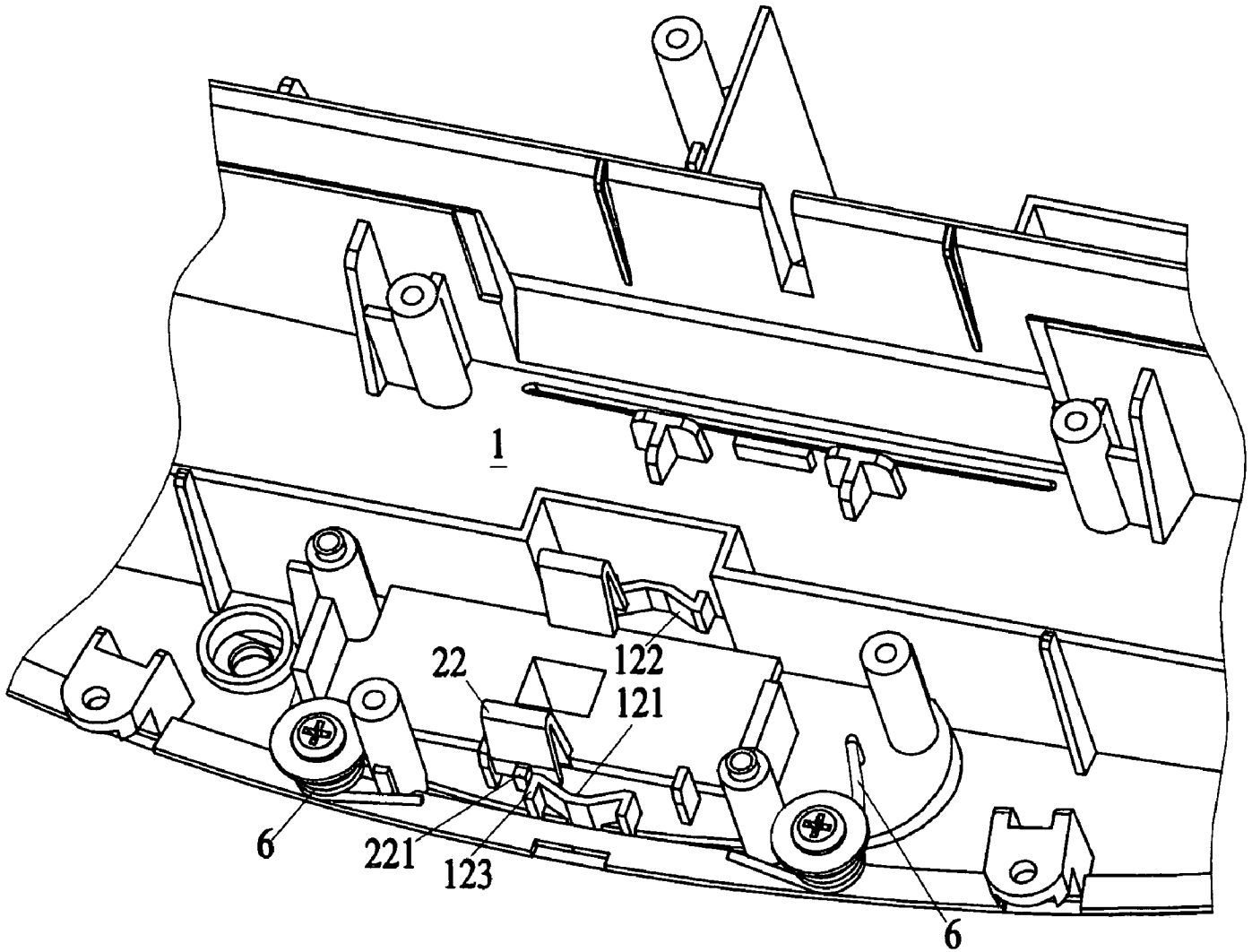
FIG. 4 shows the positions of various components of the shredder in its operating mode according to the invention.

When the switch is in the off mode, as shown in FIG. 3, the lock buttons 221 of the elastic chips 22 on both sides of the brake 2 urge against the flat surface 121 of the M-shaped positioning base 12. Both ends of the brake 2 are imposed with a pressure from the torque spring 6 as described above. When the button 21 is pushed so that the brake 2 moves in the direction of the arrow P, the switch 2 is switched to the auto or rev mode. As shown in FIG. 4, the lock button 221 moves along the slant surface 122 of the M-shaped positioning base 12. The elastic chip 22 is constantly under a pressure with the increasing slope until the lock button 221 passes through the slant surface 122 and reaches the wall surface 123 of the M-shaped positioning base 12. In this case, the elastic chip 22 automatically jumps away so that the lock button 221 is stuck in the wall surface 123. The switch 3 is fixed in that mode for the convenience of forwarding or reversing paper. However, it should be noted that during the process of pushing the switch 3, the displacement of the switch 3 is such that the torque spring 6 that constantly imposes a pressure on the brake 2 increases the pressure so as to store energy required to push the switch back to the off mode.

Figure 5:
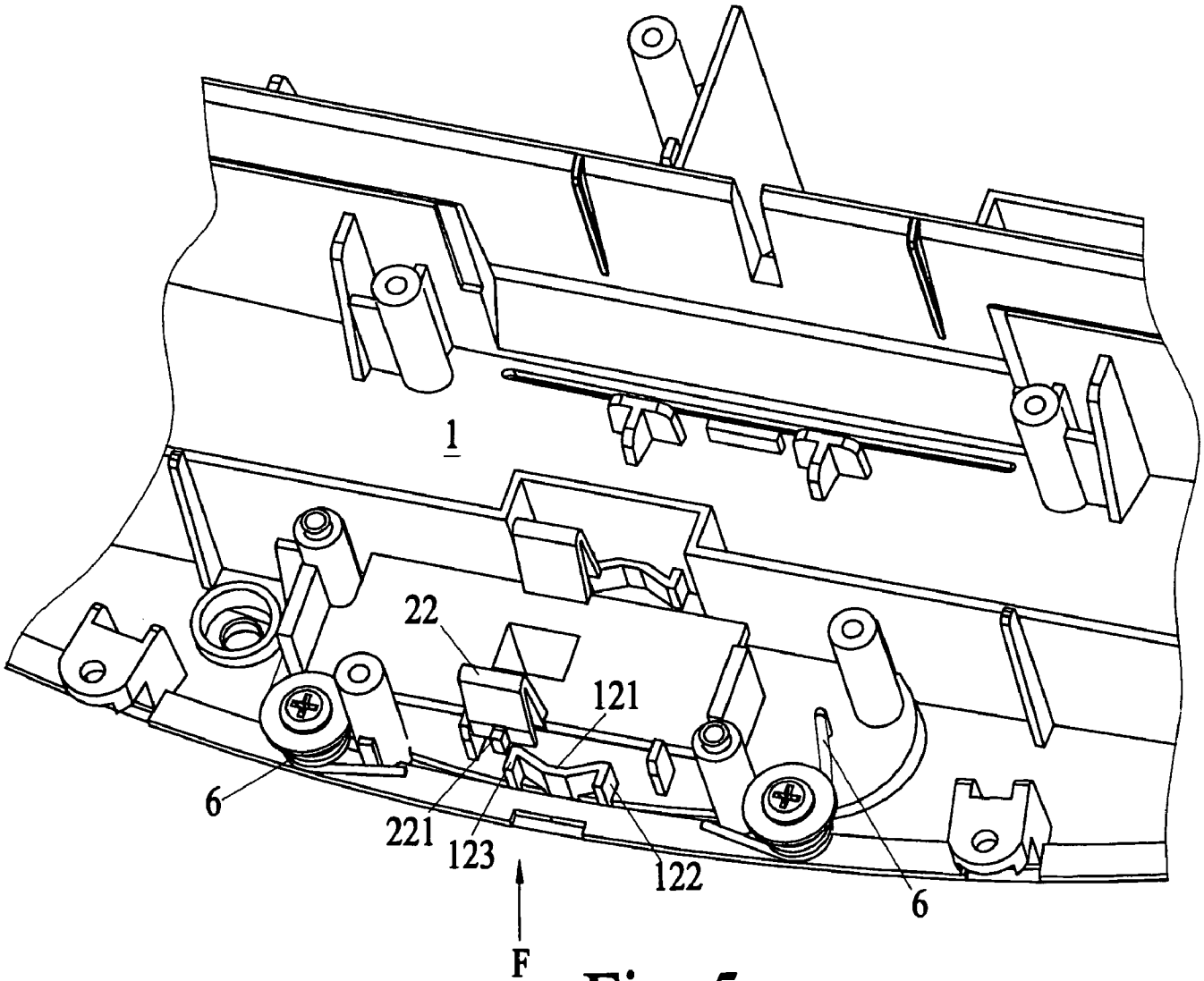
FIG. 5 shows the positions of various components of the shredder when the button is depressed according to the invention.

When an emergent situation happens and the shredder has to be turned off immediately, the user only needs to press the button 21 protruding from the shredder top cover with his/her finger or palm. The brake 2 makes a displacement downward under the pressure, as indicated by the arrow F in FIG. 5. The downward displacement of the brake 2 makes the lock button 221 depart from the fixing position in the wall surface 123. The restoring force of the torque spring 6 pushes the switch 3 back to the off mode. That is, as in FIG. 3, the lock button 221 is back the position urging against the surface 121 of the positioning base 12. The shredder stops its operation in this case to avoid further injuries.

Using the ESS design, the shredder can be shut down by the user when there is an emergent situation without worrying which way the switch should go. The user only needs to press the button down. This can increases the functionality and safety of the shredder.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An emergency stop switch (ESS) of a shredder disposed in a preformed hole on the top cover of the shredder and protruding from a top cover surface for the convenience of switching, the ESS comprising:

a switch with fwd, off, and rev modes;

a brake, which is disposed on the switch and has a control part protruding from the shredder top cover for switching among the different modes and a positioning part for assuring the switch mode;

a positioning base, which is disposed on a bottom surface of the shredder top cover opposite to the position of the positioning part for assuring the switch mode; and a restoring part, which releases stored energy to push the switch from the fwd or rev mode to the off mode;

wherein when the switch is in any of the fwd or rev mode and the controlling part of the brake that protrudes from the shredder is under a pressure to move downward, the positioning part of the brake departs from the normal fixing position of the positioning base so that the restoring part pushes the switch back to the off mode.

2. The ESS of a shredder according to claim 1, wherein a positioning block protrudes from the front surface of the switch and is mounted in a predetermined positioning hole at the bottom of the brake using a spring so that the mode switching synchronizes with the brake.

3. The ESS of a shredder according to claim 1, wherein the positioning part consists of an elastic chip extended outward from either side and a lock button provided on the elastic chip.

4. The ESS of a shredder according to claim 1, wherein the control part of the brake is a button protruding from the front surface of the brake.

5. The ESS of a shredder according to claim 1, wherein the positioning base has roughly an M shape, composed of a central flat surface section, a slant surface section extended on both sides from the flat surface with an increasing slope, and a wall surface section formed by bending the ends of the slant surfaces.

6. The ESS of a shredder according to claim 1, wherein the restoring part is a spring that constantly imposes a pressure on the brake and fixed on each side of the brake on the bottom surface of the shredder top cover.

7. The ESS of a shredder according to claim 1, wherein the lock button of the positioning part of the brake is fixed at the central flat surface section of the positioning base.

8. The ESS of a shredder according to claim 1, wherein the lock button of the positioning part of the brake is fixed in the wall surface in the fwd or rev mode.

* * * * *